US007001266B2

(12) United States Patent
Jones et al.

(10) Patent No.: US 7,001,266 B2
(45) Date of Patent: Feb. 21, 2006

(54) ROOFTOP VENT FOR REDUCING PRESSURE UNDER A MEMBRANE ROOF

(75) Inventors: James R. Jones, Blacksburg, VA (US); Demetri Telionis, Blacksburg, VA (US); Pavlos Vlachos, Blacksburg, VA (US); Elizabeth Grant, Blacksburg, VA (US); Jose Rullan, Blacksburg, VA (US); Charles S. Johnson, Wytheville, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 134 days.

(21) Appl. No.: 10/807,412

(22) Filed: Mar. 24, 2004

(65) Prior Publication Data

US 2004/0235411 A1 Nov. 25, 2004

Related U.S. Application Data

(60) Provisional application No. 60/466,441, filed on Apr. 30, 2003.

(51) Int. Cl.
*E04D 13/03* (2006.01)

(52) U.S. Cl. ..... 454/364; 454/365; 52/199

(58) Field of Classification Search ..... 454/364, 454/365, 366; 52/198, 199
See application file for complete search history.

(56) References Cited

U.S. PATENT DOCUMENTS 1,122,375 A 12/1914 Engle
1,122,431 A 12/1914 Sexton
3,302,552 A 2/1967 Walsh
3,509,811 A 5/1970 Topp
3,685,426 A 8/1972 Rosa
3,788,207 A 1/1974 Doherty, II
3,817,009 A 6/1974 Elder
3,893,383 A 7/1975 Jones
3,984,947 A 10/1976 Patry
4,016,730 A 4/1977 DeVilliers
4,162,597 A 7/1979 Kelly
4,223,486 A 9/1980 Kelly
4,512,243 A 4/1985 Ballard et al.
4,538,508 A 9/1985 Ballard
4,557,081 A 12/1985 Kelly
4,593,504 A 6/1986 Bonnici et al.
4,608,792 A 9/1986 Gerber
4,641,571 A 2/1987 Anderson et al.
4,652,321 A 3/1987 Greko
4,759,272 A * 7/1988 Zaniewski ..... 454/344
4,803,111 A 2/1989 Mansell
4,843,794 A * 7/1989 Holtgreve ..... 52/199

(Continued)

*Primary Examiner*—Derek S. Boles
(74) *Attorney, Agent, or Firm*—Whitham, Curtis & Christofferson, PC

(57) ABSTRACT

Membrane roofs are susceptible to damage in high winds. Wind can lift a membrane roof from a building and cause it to tear or become damaged. The present roof vent prevents liftoff and damage by reducing the air pressure under the membrane during high winds. The present roof vent has two opposed convex domes separated by a gap. Wind blowing across the roof flows between the domes where it accelerates and creates a region of low pressure according to the Venturi effect. The lower dome has an opening at the gap so that the low pressure is applied to the space under the membrane roof. Therefore, when wind blows across the roof, the vent draws air from under the membrane and the membrane is pressed against the roof, preventing liftoff.

20 Claims, 3 Drawing Sheets

U.S. PATENT DOCUMENTS 4,848,653 A 7/1989 Van Becelaere
4,850,166 A 7/1989 Taylor
4,876,950 A 10/1989 Rudeen
4,888,930 A 12/1989 Kelly
4,909,135 A 3/1990 Greko
4,963,761 A 10/1990 Wight
4,965,971 A * 10/1990 Jean-Jacques et al. ..... 52/199
5,009,149 A 4/1991 MacLeod et al.
5,734,215 A 3/1998 Taghezout et al.
5,749,780 A 5/1998 Harder et al.
5,766,071 A 6/1998 Kirkwood
6,006,482 A 12/1999 Kelly
6,325,712 B1 12/2001 Lawless, III et al.
6,484,459 B1 11/2002 Platts

* cited by examiner

ROOFTOP VENT FOR REDUCING PRESSURE UNDER A MEMBRANE ROOF

CROSS-REFERENCE TO RELATED APPLICATIONS

This application is related to U.S. Provisional Patent Application Ser. No. 60/466,441 filed Apr. 30, 2003, and the complete contents of that application is herein incorporated by reference.

FIELD OF THE INVENTION

The present invention relates generally to rooftop vents, and, more specifically, to a vent for reducing pressure under a membrane roof during windstorms.

BACKGROUND OF THE INVENTION

Membrane roof systems are commonly used in low-slope roofs. A membrane roof typically comprises a rubber or plastic (e.g., made of PVC) sheet that provides a moisture and vapor barrier. Membrane roofs are relatively inexpensive to install and consequently the use of membrane roof systems has been expanding in recent years.

One problem with membrane roofs is that they are susceptible to damage from high winds. High winds create a reduced air pressure on the top surface of the membrane, which cause it to lift from the building. A membrane roof lifted from the subroof can be torn from the building or damaged in other ways.

Hence, one of the challenges of designing membrane roof systems is providing an attachment method strong enough to prevent uplift of the membrane during high wind conditions. Conventional methods for attachment include mechanical fasteners, adhesive layers or ballast. These methods have a tendency to increase heat transmission through the roof, which increases heating and cooling costs. Also, these methods are not completely reliable in very high winds.

Alternative methods for fastening membrane roofs include a turbine vent system (made by Burke Industries) and a passive vent (made by the 2001 Company). These vent systems provide reduced air pressure under the membrane to hold it in place. However, both these solutions require air-tight deck assemblies for efficient operation and have a relatively high manufacturing cost.

It would be an advance in the art of membrane roof systems to provide a roof that resists uplift in very high wind conditions. It would be particularly beneficial for the roof to be inexpensive, simple to install, and compatible with already installed membrane roofs.

SUMMARY

The present invention provides a roof vent for use with membrane roofs. The present vent includes a lower dome and an upper dome separated by a gap. The domes are shaped and positioned so that the distance between the domes is smallest at the center and greatest at the periphery. This structure induces the Venturi effect when wind blows between the domes. The lower dome has a port that is open to a space under a roof membrane. When wind blows through the present roof vent, low pressure is created at the port by the Venturi effect, and the low pressure is applied to the space under the membrane.

The vent has a horizontal flange on the lower dome for attachment to a roof membrane. The horizontal flange may have feet on its lower surface to lift the vent base above the subroof and allow airflow between the subroof and flange.

Preferably, the port is located where the distance between domes is smallest.

The vent can include a drip edge on the upper dome to prevent water from dripping into the port. The lower dome can include a drip pan and drain to collect and exhaust undesired water that falls into the port.

Also, the present invention includes embodiments where one of the upper dome or lower dome is flat.

The present invention also includes a membrane roof system having a roof membrane in combination with the present roof vent. In the present membrane roof system, a porous layer or grooves can be provided under the membrane so that air can flow under the membrane. This feature maximizes the area of reduced pressure and helps prevent trapped pockets of air under the membrane.

DETAILED DESCRIPTION OF THE PREFERRED EMBODIMENT OF THE INVENTION

The present invention provides a roof vent and roof system that reduces air pressure under a membrane roof when wind blows, thereby holding down the membrane roof. The present roof vent employs the Venturi effect to reduce the pressure under the membrane. The reduced pressure tends to prevent uplift during high wind events. Specifically, the present roof vent has two hollow domes separated by a gap. When wind blows, airflow is forced through the gap between the domes where it creates a zone of low pressure due to the Venturi effect. The bottom dome has a port located at the gap. The port is open to the space under the membrane roof. Therefore, when air flows between the two domes, the low pressure at the port tends to draw air from under the membrane and air pressure under the membrane is reduced to less than the atmospheric pressure.

Figure 1:
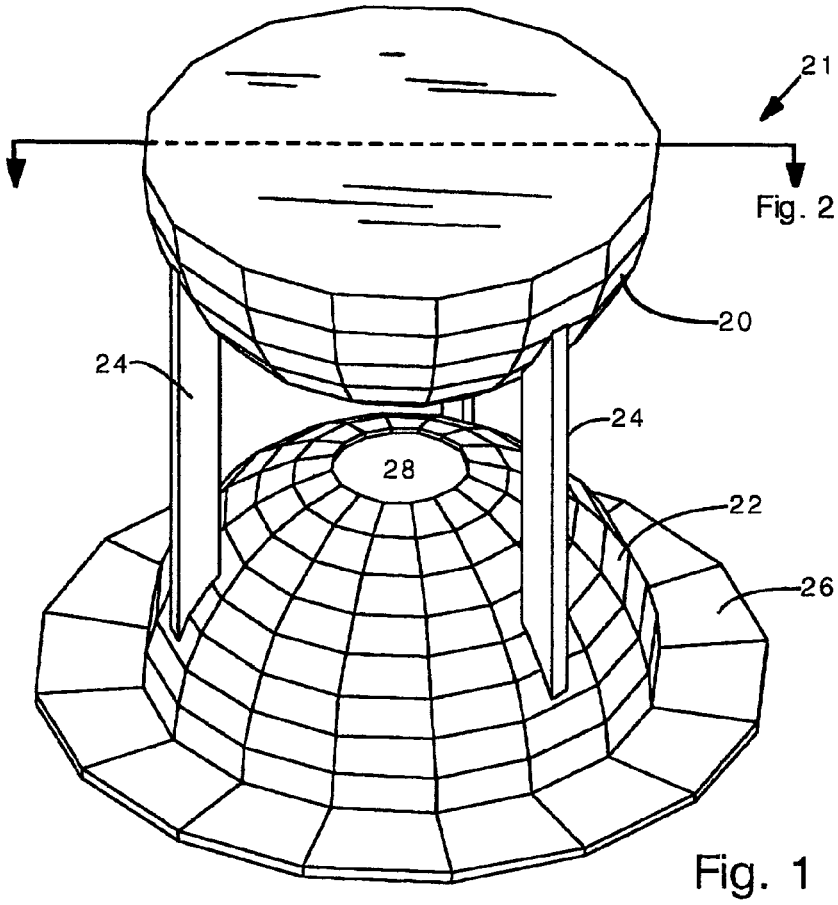
FIG. 1 shows a perspective view of the present membrane roof vent.

FIG. 1 shows a perspective view of the present roof vent 21. The roof vent 21 has an upper dome 20, a lower dome 22 and legs 24. Legs 24 support the upper dome 20 above the lower dome 22. Upper dome 20 is preferably closed on the top, so that it does not collect rainwater. Lower dome 22 preferably has a horizontal flange 26 for attachment to a membrane roof. Lower dome also has a port 28 located at the point closest to the upper dome 20. Both the upper dome 20 and lower dome are hollow.

The entire roof vent can be made of molded plastic such as polypropylene, polycarbonate or PVC. Metal or fiberglass can also be used. Preferably, the vent is made of a material that is resistant to damage from UV exposure.

Upper dome 20 has a bottom surface facing the lower dome 22. The bottom surface can be hemispherical or any other convex shape. Alternatively, the bottom surface is flat. The bottom surface of the upper dome cannot be concave. Similarly, the lower dome 22 has a top surface facing the bottom surface of the upper dome 20. The top surface can be hemispherical or any other convex shape. Alternatively, the top surface is flat. At least one of the top surface and bottom surface is convex; both the top surface and bottom surface cannot be flat.

The size of the domes can vary widely. For example, the diameter of the domes can be in the range of 4–12 inches, or larger.

The size of the port 28 can also vary widely. For example, the port can be ⅛ to 2 inches in diameter. The port can also include a porous screen (not shown) so that debris does not accumulate within the lower dome.

Figure 2:
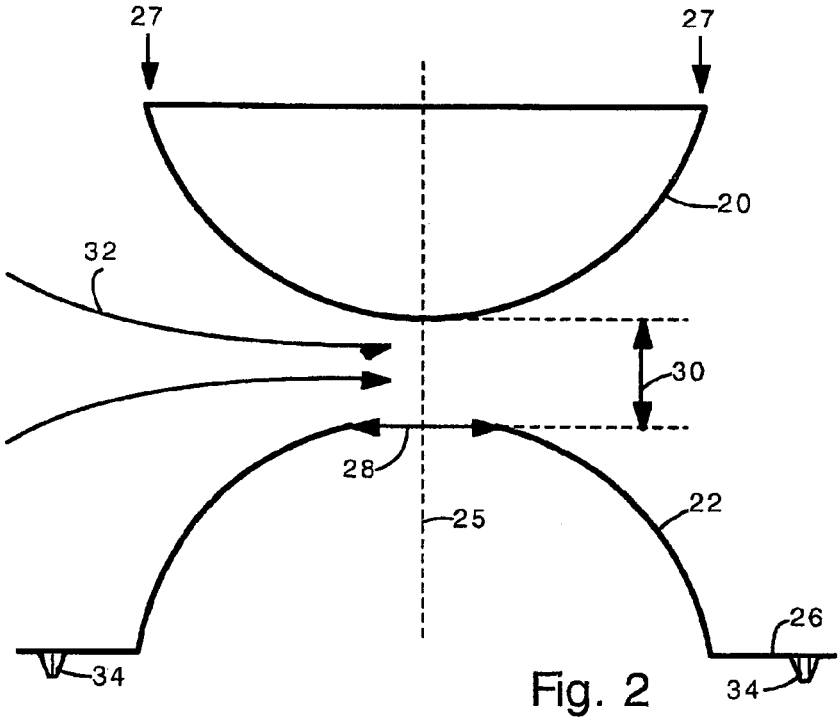
FIG. 2 shows a cross-sectional view of the present membrane roof vent.

FIG. 2 shows a cross sectional view of the present roof vent 21. The domes 20 22 are separated by a gap 30. The size of the gap can vary widely, but will typically be about 1–3 inches for vents with dome diameters of about 10 inches. Preferably, the size of the gap 30 is selected so that the magnitude of air pressure reduction at the port 28 is maximized for typical wind speeds.

The roof vent may have feet 34. Feet 34 provide an airspace under the flange when the vent is placed on a flat surface.

The vent has a center 25 and a periphery 27. Preferably, but not necessarily, the vent is circularly symmetric about the center 25. The gap spacing between the domes 20 22 necessarily decreases from the periphery to the center 25.

Figure 3:
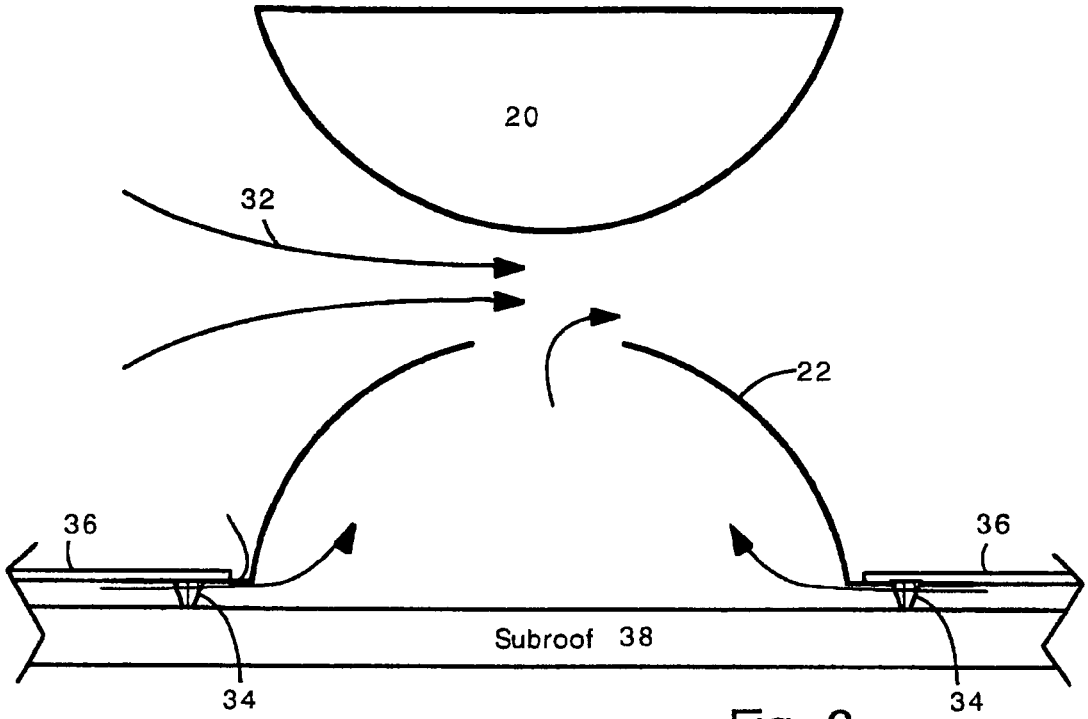
FIG. 3 shows the present roof vent in combination with a membrane roof.

FIG. 3 shows the present roof vent installed in a membrane roof system. The membrane roof includes a plastic membrane 36. A subroof 38 is located under the membrane roof. The subroof typically is a wood, metal, concrete, tectum, gypsum or rigid insulation material and may be covered with tarpaper or similar building materials. The subroof 38 is part of the building structure.

The plastic membrane is typically made of flexible fabric-reinforced PVC, but can also be a thermoplastic or thermoset with or without fabric reinforcement. The membrane 36 has a circular hole with a diameter slightly larger than the diameter of the lower dome 22. The membrane 36 is bonded to the horizontal flange 26 (the flange can be above or below the membrane). The flange 26 and membrane 36 can be bonded by chemical adhesives, solvents or heat, for example. The bond between the flange 26 and membrane 36 must be water tight.

In operation, wind 32 blowing over the membrane roof flows between the domes 20 22. The velocity of the air increases as it flows toward the center 25 as a result of the decrease in distance between the domes. Consequently, the air pressure in the center is reduced according to Bernoulli's law, as known in the art. Low pressure at the port 28 is applied inside the lower dome and to the space under the membrane 36. Air under the membrane flows under the flange 26 between the feet 34 and out through the port 28. In this way, the air pressure under the membrane 36 will always be kept lower than the atmospheric air pressure when wind is blowing. The reduction in air pressure under the membrane tends to press the membrane against the subroof 38, thereby protecting the membrane 36 from liftoff and wind damage.

The air pressure in the lower dome decreases with increasing wind speed. Therefore, the membrane 36 is held down against the subroof 34 with greater force in high winds.

In experiments performed by the present inventors with a vent having 10-inch diameter, hemispheric upper and lower domes separated by 2 inches, a 150 mph windspeed produced a pressure drop equivalent to about 10 inches of water. This pressure reduction is sufficient to prevent liftoff for most typical membrane roofs. These experiments were conducted in a wind tunnel and the size of te gap was varied to determine the optimum gap spacing.

It is noted that the present roof vent is omnidirectional with respect to wind direction. The roof vent provides reduced air pressure for wind blowing in any direction as a result of its circular symmetry.

Figure 4:
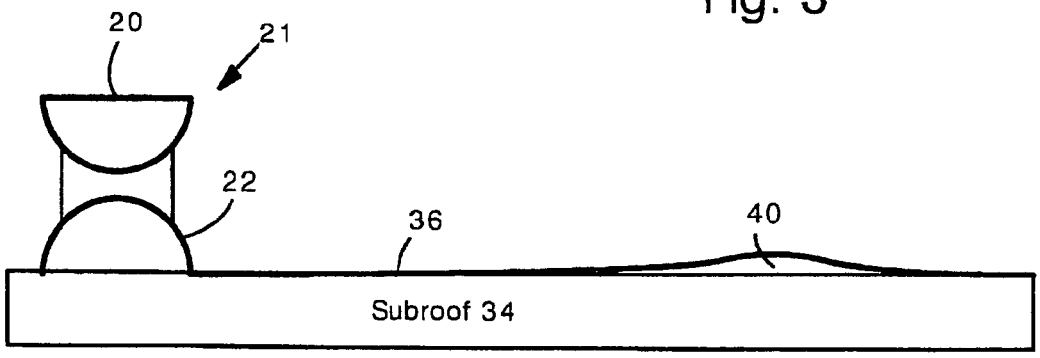
FIG. 4 shows a larger view of a membrane roof with the roof vent and an air pocket under the membrane.

It is important in the present invention to assure that air can flow in the space between the membrane 36 and subroof 34. If, for example, the subroof 34 has a smooth upper surface, then the subroof can form a relatively airtight seal with the membrane 36. Such a seal can trap pockets of air under the membrane 36 and reduce the propagation of the negative pressure zone under the membrane. FIG. 4 illustrates a trapped air pocket 40. The pocket 40 cannot be exhausted by the vent 21 because the membrane 36 and subroof 34 form a seal in the area around the vent 21.

In order to prevent the formation of air pockets 40, tubes or porous mesh can be provided between the subroof 34 and membrane 36. Alternatively, a network of grooves can be formed in the subroof so that the membrane cannot form a seal with the subroof.

Figure 5:
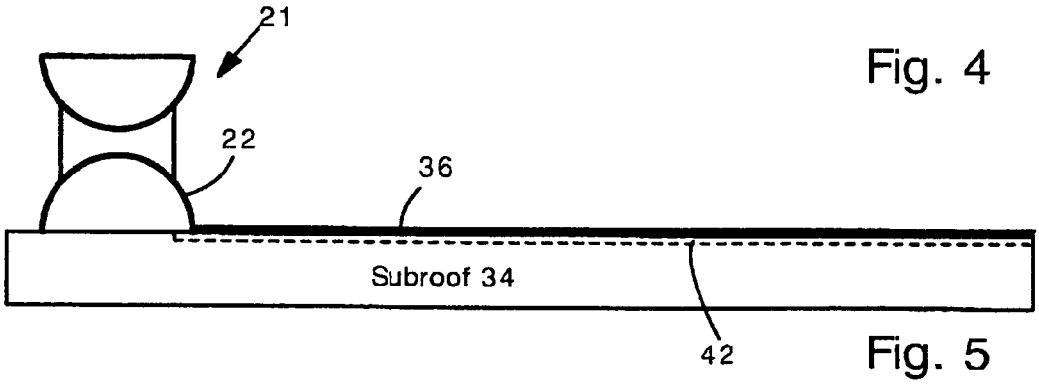
FIG. 5 shows a membrane roof having grooves in the subroof.
Figure 6:
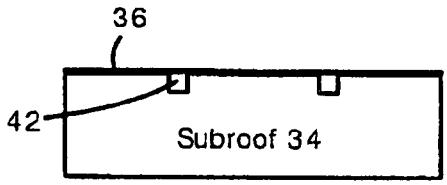
FIG. 6 shows a cross-sectional view of the groove in the subroof.

FIG. 5 illustrates a subroof 34 with a groove 42. The groove 42 extends from the lower dome 22 so that the dome is fluidically connected to the entire area under the membrane 36. FIG. 6 shows a cross sectional view of an exemplary groove. The groove can have dimensions ranging from ⅛ inch square to more than ¼ inch square, for example.

Figure 7:
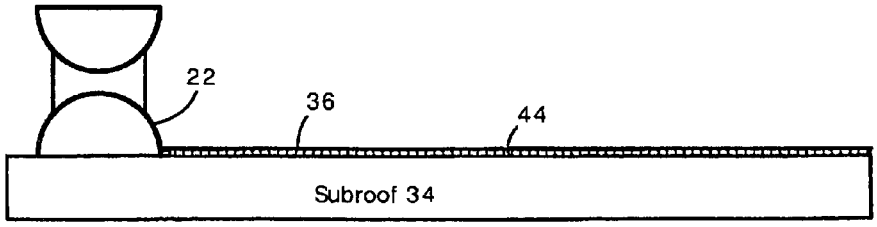
FIG. 7 shows a membrane roof having a porous layer between the membrane and subroof.

FIG. 7 shows an alternative embodiment of the membrane roof having a porous layer 44 disposed between the membrane and subroof. The porous layer 44 assures that the vent can evacuate air from all areas under the membrane. The porous layer can be made of a network of tubes, an open weave rigid fiber or similar materials. The porous layer can have a thickness of about ⅛ inch to 2 inches, for example.

Figure 8:
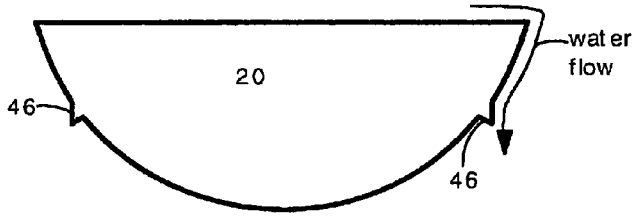
FIG. 8 shows an embodiment of the roof vent having features to prevent water from flowing under the membrane roof.
Figure 8:
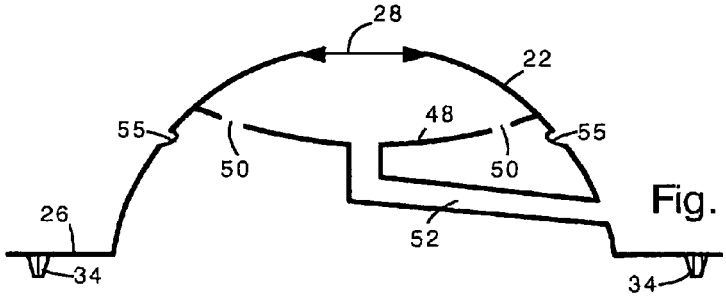

FIG. 8 shows another embodiment of the invention having features that prevent water from entering the vent and flowing under the membrane 36. Preferably, the present roof vent includes a drip edge 46 that circumscribes the upper dome. Droplets of water flowing down the sides of the upper dome are forced to drop from the drip edge 46, as illustrated by the arrow. Without the drip edge 46, droplets clinging to the upper dome 20 will drop into the lower dome 22 through the port 28.

Also, the present roof vent preferably includes a drip pan 48 disposed in the lower dome. The drip pan is located under the port 28. The drip pan 48 has holes 50 around its perimeter to allow airflow between the port 28 and the space under the membrane 36.

Also, the lower dome can include a drain 52 that collects water from the drip pan and passes it onto the roof. Alternatively, no drain is included, and the drip pan is cleared of water by evaporation. The drain 52 should include a check valve that allows water to flow from the pan but prevents air from entering the drain 52. The check valve can be a ball valve 60 or a flap 62. Alternatively, the drain can have a small orifice 64 that greatly reduces the amount of air that can enter the lower dome.

Additionally, the vent may include a rain diverter 55. The rain diverter 55 is an annular depression or ridge that circumscribes the lower dome. During high winds, water on the roof can be blown onto the lower dome 22 and possibly enter the port 28. The rain diverter 55 prevents this problem by diverting wind-blown water to travel around the lower dome. The rain diverter 55 can be a recessed area, as shown, or can be a raised ridge.

With the drip edge 46, drip pan 48, drain 52 and rain diverter 55, the amount of water that enters the lower dome will be greatly reduced or eliminated.

Figure 9:
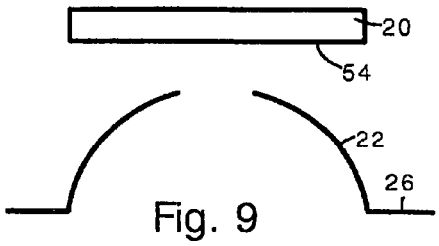
FIGS. 9 and 10 show alternative embodiments having flat surfaces.
Figure 10:
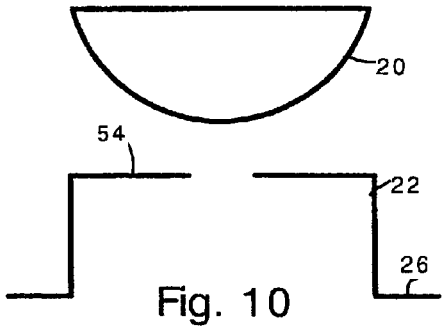

FIGS. 9 and 10 illustrate alternative embodiments of the present invention in which the lower dome or upper dome, respectively, have flat surfaces 54. The opposing dome has a convex surface. In the present invention, at least one dome must have a convex surface so that airflow is constricted as it passes between the domes and the Venturi effect occurs. Roof vents with a single flat surface are included within the scope of the appended claims.

In the present membrane roof system, the roof vents should be spaced on a roof according to a grid pattern. For example, the roof vents can be spaced every 10, 20 or 30 feet in a rectangular or hexagonal grid. The proper spacing depends on the liftoff characteristics of the roof, the air flow characteristics of the space under the membrane, and the size and shape of the domes. The proper spacing for the roof vents can be determined empirically. Also, the present roof vents should not be located behind obstructions that can impede wind, such as parapets, short vertical walls, or chimneys. The present roof vents should be exposed to wind blowing over the roof.

It will be clear to one skilled in the art that the above embodiment may be altered in many ways without departing from the scope of the invention. Accordingly, the scope of the invention should be determined by the following claims and their legal equivalents.

What is claimed is:

1. A roof vent for use with membrane roofs, comprising:

a) a lower dome with a port in a top surface;

b) an upper dome supported above the lower dome, wherein the upper dome has a bottom surface;

wherein the top surface and bottom surface face each other and are spaced apart;

wherein a distance between the top and bottom surfaces decreases smoothly from a periphery to a center of the vent; and c) a horizontal flange circumscribing a bottom of the lower dome.

2. The roof vent of claim 1 further comprising at least 2 feet under the flange.

3. The roof vent of claim 1 wherein the port is located where the distance between top and bottom surfaces is smallest.

4. The roof vent of claim 1 further including a drip edge circumscribing the upper dome.

5. The roof vent of claim 1 further including a drip pan inside the lower dome.

6. The roof vent of claim 5 further including a drain extending from the drip pan to outside the lower dome.

7. The roof vent of claim 1, wherein one of the top surface or the bottom surface is substantially flat.

8. The roof vent of claim 1, wherein the top surface and the bottom surface are both convex.

9. A membrane roof, comprising:

a) a roof membrane with a hole;

a) a lower dome with a port in a top surface;

b) an upper dome supported above the lower dome, wherein the upper dome has a bottom surface;

wherein the top surface and bottom surface face each other and are spaced apart;

wherein a distance between the top and bottom surfaces decreases smoothly from a periphery to a center of the vent; and c) a horizontal flange circumscribing a bottom of the lower dome, wherein the flange is secured to the roof membrane in an area circumscribing the hole.

10. The membrane roof of claim 9 further comprising a subroof disposed under the membrane, wherein the subroof includes grooves conductive to airflow.

11. The membrane roof of claim 9 further comprising a porous layer conductive to airflow under the membrane.

12. The membrane roof of claim 9 further comprising at least 2 feet under the flange.

13. The membrane roof of claim 9 wherein the port is located where the distance between top and bottom surfaces is smallest.

14. The membrane roof of claim 9 further including a drip edge circumscribing the upper dome.

15. The membrane roof of claim 9 further including a drip pan inside the lower dome.

16. The membrane roof of claim 15 further including a drain extending from the drip pan to outside the lower dome.

17. The membrane roof of claim 9, wherein one of the top surface or the bottom surface is substantially flat.

18. The membrane roof of claim 9, wherein the top surface and the bottom surface are both convex.

19. A roof vent for use with membrane roofs, comprising:

a) a lower dome with a convex surface and a port in the convex surface;

b) an upper dome supported above the lower dome, wherein the upper dome has a convex surface;

wherein the convex surfaces face each other and are separated by a gap;

c) a horizontal flange circumscribing a bottom of the lower dome.

20. The roof vent of claim 19 further including a drip edge circumscribing the upper dome.

* * * * *